US006802883B2

(12) United States Patent
Henmi et al.

(10) Patent No.: US 6,802,883 B2
(45) Date of Patent: Oct. 12, 2004

(54) IRON-BASED SINTERED ALLOY FOR USE AS VALVE SEAT AND ITS PRODUCTION METHOD

(75) Inventors: Hiroji Henmi, Saitama (JP); Akiyoshi Ishibashi, Saitama (JP)

(73) Assignee: Kabushiki Kaisha Riken, Tokyo (JP)

( * ) Notice: Subject to any disclaimer, the term of this patent is extended or adjusted under 35 U.S.C. 154(b) by 0 days.

(21) Appl. No.: 10/383,870

(22) Filed: Mar. 10, 2003

(65) Prior Publication Data

US 2003/0230164 A1 Dec. 18, 2003

(30) Foreign Application Priority Data

Mar. 12, 2002 (JP) ..... 2002-066907

(51) Int. Cl.[7] ..... C22C 33/02

(52) U.S. Cl. ..... 75/240; 75/231; 75/244; 75/246; 419/12; 419/14; 419/36

(58) Field of Search ..... 75/231, 240, 244, 75/246, 243; 419/12, 14, 36, 10, 11

(56) References Cited

U.S. PATENT DOCUMENTS 3,918,923 A 11/1975 Inoue ..... 29/182.5
4,274,876 A * 6/1981 Kodama et al. ..... 75/243
4,505,988 A * 3/1985 Urano et al. ..... 428/569
4,836,848 A * 6/1989 Mayama et al. ..... 75/231
5,080,713 A * 1/1992 Ishibashi et al. ..... 75/246
5,859,376 A 1/1999 Ishibashi et al. ..... 75/243
6,139,599 A * 10/2000 Takahashi et al. ..... 75/246
6,305,666 B1 * 10/2001 Sakai ..... 251/368

FOREIGN PATENT DOCUMENTS

JP 11-302806 11/1999
JP 11-303847 11/1999

* cited by examiner

*Primary Examiner*—Ngoclan T. Mai
(74) *Attorney, Agent, or Firm*—Kubovcik & Kubovcik

(57) ABSTRACT

An iron-based sintered alloy, which consists of from 0.5 to 5% of Ni, from 0.5 to 4% of Cr, from 0.5 to 2% of C, the balance being Fe and unavoidable impurities, and which has a micro-structure comprising an iron-based matrix containing Ni and a part of Cr as solutes and carbides containing the other part of Cr and dispersed in the matrix. The iron-based sintered alloy is appropriate for use as a valve seat of an internal combustion engine. Wear resistance is maintained at a moderate level while the additive amount of alloying elements is decreased to attain low cost.

22 Claims, 1 Drawing Sheet

IRON-BASED SINTERED ALLOY FOR USE AS VALVE SEAT AND ITS PRODUCTION METHOD

BACKGROUND OF INVENTION

1. Field of Invention

The present invention relates to an iron-based sintered alloy with high performance and low cost for use as a valve seat of all internal combustion engine. The present invention also relates to a production method of the iron-based sintered alloy.

2. Description of Related Art

There is a tendency of increasing thermal load and mechanical load, to which the valve seat of an engine is subjected, along with the performance increase of an internal combustion engine as increasing the fuel efficiency and reducing an exhaust emission. In order to cope with this tendency, the sintered alloy to be used as valve seats has been strengthened by means of high alloying, forging, or copper infiltration. For example, chromium (Cr), cobalt (Co) and tungsten (W), which are added in the raw material powder for producing the iron-based sintered alloy, enhance the high-temperature strength of the alloy. Copper infiltration enhances the thermal conductivity of the sintered compact and hence indirectly enhances the high-temperature strength. Meanwhile, the strengthening of the sintered alloy by means of high-pressure compacting, powder forging, cold forging and high-temperature sintering are effective for increasing the mechanical strength of the sintered compact.

The present applicant proposed the iron-based sintered alloy, which consists of an iron base matrix with nickel (Ni)-molybdenum (Mo)-chromium (Cr)-carbon (C) and hard particles dispersed in the matrix, in Japanese Unexamined Patent Publication (kokai) No. 09-053158 (hereinafter referred to as "prior application"). However the proposed alloy is expensive since the matrix contains a large amount of expensive alloying elements. In the prior application, the performance of a valve seat is evaluated in terms of valve clearance between a cam and a cam follower. The valve clearance is mainly the total wear of the valve seat and the valve which are subject to hammering and sliding wear. The present inventors paid attention to the respective parts subject to the hammering and sliding wear and made further researches and discovered that high-alloying can be avoided.

Copper infiltration into the internal poles of the sintered compact enhances the thermal conductivity, so that the temperature of the material is not liable to rise even when the combustion temperature becomes high. Wear-resistance at high temperature is thus enhanced and the usable temperature of the iron-based alloy is increased. However, the copper-infiltrated sintered alloy needs secondary sintering, which increases the production cost.

SUMMARY OF INVENTION

It is, therefore, an object of the present invention to provide an iron-based sintered alloy, in which the alloying elements are reduced to the minimum level, for use as a valve seat of an internal combustion engine.

It is also an object of the present invention to provide a method for producing an iron-based sintered alloy for use as a valve seat of an internal combustion engine without secondary treatment such as copper infiltration.

In accordance with the objects of the present invention, there is provided an iron-based sintered alloy, which consists, by weight %, of from 0.5 to 5% of nickel (Ni), from 0.5 to 4% of chromium (Cr), from 0.5 to 2% of carbon (C), the balance being iron (Fe) and unavoidable impurities, and which has a microstructure comprising an iron-based matrix containing the nickel (Ni) and a part of the chromium (Cr) as solutes and carbides containing the other part of the chromium (Cr) and dispersed in the iron-based matrix. This alloy is hereinafter referred to as the Fe—Ni—Cr—C alloy.

The iron-based sintered alloy according to the present invention may additionally contain one or more of the following hard particles.

(1) Hard particles which consist, by weight %, of from 50 to 57% of chromium (Cr), from 18 to 22% of molybdenum (Mo), from 8 to 12% of cobalt (Co), from 0.1 to 1.4% of carbon (C), from 0.8 to 1.3% of silicon (Si) and the balance being iron (Fe).

(2) Hard particles which consist, by weight %, of from 27 to 33% of chromium (Cr), from 22 to 28% of tungsten (W), from 8 to 12% of cobalt (Co), from 1.7 to 2.3% of carbon (C), from 1.0 to 2.0% of silicon (Si) and the balance being iron (Fe).

(3) Hard particles which consist, by weight %, of from 60 to 70% of molybdenum (Mo), 0.0% less of carbon and the balance being iron (Fe).

(4) Hard particles which consist of Stellite alloy

The hard particles are in an amount of from 3 to 20% by weight based on the iron-based sintered alloy, i.e., total of the Fe—Ni—Cr—C alloy and the hard particles. The hard particles are preferably of less than 150 $\mu$m of particle size.

In the iron-based sintered alloys mentioned above, solid lubricant such as fluoride ($LiF_2$, $CaF_2$, $BaF_2$ and the like), boride (BN and the like) and the sulfide (MnS and the like) may be uniformly dispersed. The amount of the solid lubricant is from 1 to 20% by weight based on the iron-based sintered alloy, i.e., the total of the Fe—Ni—Cr—C alloy and the solid lubricant, and occasionally the hard particles. The solid lubricant is preferably of less than 45 $\mu$m of particle size.

A preferred method for producing the iron-based sintered alloy according to the present invention comprises the steps of:

preparing the raw material powder, which consists, by weight %, of from 0.5 to 5% of nickel (Ni), from 0.5 to 4% of chromium (Cr), from 0.5 to 2% of carbon (C) and the balance being iron (Fe) and unavoidable impurities by using at least an iron (Fe)-chromium (Cr) powder capable of supplying the total amount of chromium (Cr);

mixing zinc stearate and said raw material powder to prepare a green mixture;

pressing the green mixture to form a green compact;

heating the green compact to dewax; and, sintering the green compact followed by cooling and then, annealing if necessary.

Preferably, the raw material powder consists of pure-iron (Fe) powder having average particle size of 75~150 $\mu$m, iron (Fe)-chromium (Cr) alloy powder containing chromium (Cr) of from (10) to (14)% having average particle size of 75~106 $\mu$m, nickel (Ni) powder having particle size less than 45 $\mu$m and fine graphite (C) powder. The nickel powder is preferably pure nickel powder. The method may further comprise a step of mixing the raw material powder with from 3 to 20% of one or more hard particles selected from (1) hard particles which consist of from 50 to 57% of chromium (Cr), from 18 to 22% of molybdenum (Mo), from 8 to 12% of cobalt (Co), from 0.1 to 1.4% of carbon (C), from 0.8 to 1.3 of silicon (Si) and the balance being iron (Fe), (2) hard particles which consist of from 27 to 33% of chromium (Cr), from 22 to 28% of tungsten (W) from 8 to 12% of cobalt (Co), from 1.7 to 2.3% of carbon (C), from 1.0 to 2.0% of silicon (Si) and the balance being iron (Fe), (3) hard particles which consist of from 60 to 70% of molybdenum (Mo), 0.01% or less of carbon and the balance being iron (Fe), and (4) hard particles which consist of Stellite alloy, and/or with from 1 to 20% of solid lubricant, as well as with the zinc stearate, thereby preparing green mixture.

DESCRIPTION OF PREFERRED EMBODIMENTS

The composition of the iron-based sintered alloy according to the present invention is hereinafter described.

Nickel (Ni) is dissolved in the iron (Fe) matrix and enhances its strength and heat resistance. Wear resistance of the iron-based sintered alloy at the operation temperature of the valve is thus enhanced. The addition amount of nickel (Ni) is from 0.5 to 5%. When the addition amount of nickel (Ni) is less than 0.5%, the wear resistance is not satisfactorily improved. On the other hand, when the nickel (Ni) content is more than 5%, although the mechanical properties of the iron-based sintered alloy are excellent, the opposite material (valve) is seriously worn out (see examples No. 28 and No. 29), probably because the high Ni content of the valve seat results in disadvantageous adhesive wear condition with the valve which has high nickel (Ni) content to enhance the heat resistance. Such phenomenon is known as the sliding of materials of the same kind. In addition, when the nickel (Ni) content is more than 5%, the cost increases disadvantageously. The nickel (Ni) content is, therefore, from 0.5 to 5%, preferably from 1.5 to 3%.

The chromium (Cr) content is from 0.5 to 4%. When the chromium (Cr) content is less than 0.5%, the heat resistance and the oxidation resistance are not improved satisfactorily. On the other hand, when the chromium (Cr) content is more than 4%, the amount of carbides formed is so large that the machining of the iron-based sintered alloy are disadvantageously difficult, and, further, the alloy is embrittled.

In order to uniformly dissolve chromium (Cr) and disperse chromium carbides (CrxCy) in the iron-based matrix, iron-powder containing chromium (Cr) or iron (Fe)-nickel (Ni) powder containing chromium (Cr) can be used. For example, atomized iron-chromium powder and iron-nickel-chromium powder are commercially available. Such powder is expensive and cost reduction cannot be attained. Nickel (Ni) should, therefore, be used in the form of pure nickel (Ni) powder having preferably the particle size of less than 45 $\mu$m.

When the chromium (Cr) in the form of metallic chromium (Cr) is added in the raw material powder the chromium (Cr) reacts with carbon (C) and forms large and hard carbides. In addition, since chromium (Cr) carbide has poor wettability with the iron-based matrix, there is a disadvantage that the opposite materials is attacked by the chromium carbides which work as abrasives. Desirably, the chromium (Cr) is preliminarily dissolved in the iron (Fe), and the so-prepared Fe—Cr powder is used as the main material. Chromium carbides dispersed in the iron-based matrix are desirably as fine as (20) $\mu$m or less in average.

Carbon (C) content is from 0.5 to 2%. When the carbon (C) content is less than 0.5%, ferrite ($\alpha$ solid solution) comes out and lowers the wear resistance. On the other hand, when the carbon (C) content is more than 2%, martensite and carbides are formed in excess so that the machining of the iron-based sintered alloy becomes disadvantageously difficult and such alloy is embrittled.

The content of carbon (C) is determined within the range of 0.5 to 2% taking the nickel (Ni) and chromium (Cr) contents and the kind and amount of the hard particles into consideration in such a manner that the ferrite and martensite in excess are not formed. Area % of ferrite should be 5% or less. Area % of martensite should be 20% or less.

The hard particles used occasionally has generally Hv 900 or more of hardness and has a particle size of 45 to 106 $\mu$m.

Preferred hard particles are as follows.

(1) Hard particles which consist of from 50 to 57% of chromium (Cr), from 18 to 22% of molybdenum (Mo), from 18 to 12% of cobalt (Co), from 0.1 to 1.4% of carbon (C), from 0.8 to 1.3% of silicon (Si), the balance being iron (Fe).

(2) Hard particles which consist of from 27 to 33% of chromium (Cr), from 22 to 28% of tungsten (W), from 8 to 12% of cobalt (Co), from 1.7 to 2.3% of carbon (C), from 1.0 to 2.0% of silicon (Si) and the balance being iron (Fe).

(3) Hard particles which (consist of from 60 to 70% of molybdenum (Mo), 0.01% less of carbon (C) and the balance being iron (Fe).

(4) Hard particles which consist of Stellite alloy

The hard particles dispersed enhance the wear resistance of the valve seat by dispersion strengthening. The alloying elements of the hard particles diffuse from those particles and form a high-alloy layer around the particles. The wear resistance is, therefore, significantly improved. The amount of hard particles is from 3 to 20%. When the amount of hard particles is less than 3%, the wear resistance is not improved sufficiently. When the amount of hard particles is more than 20%, the wear resistance is not so improved commensurate with the amount. The iron-based sintered alloy is embrittled and involves, therefore, problems in strength and machinability. The opposite valve tends to be worn out greatly along with the increase of the amount of hard particles. The cost increases as well. From such several points of view, the amount more than 20% of hard particles is not preferable.

The present invention is characterized as compared with the prior application in the following points: (1) the wear resistance of a valve seat is maintained at a moderate level; (2) the wear of the valve seat and the valve, which are subjected to hammering and sliding action with respect to one another, is comprehensively improved; and, (3) the alloying elements of the iron matrix are decreased to the minimum level to reduce the cost.

The iron-based sintered alloy for use as a valve seat and its production method according to the present invention is explained with reference to the examples.

EXAMPLES

Figure 1:
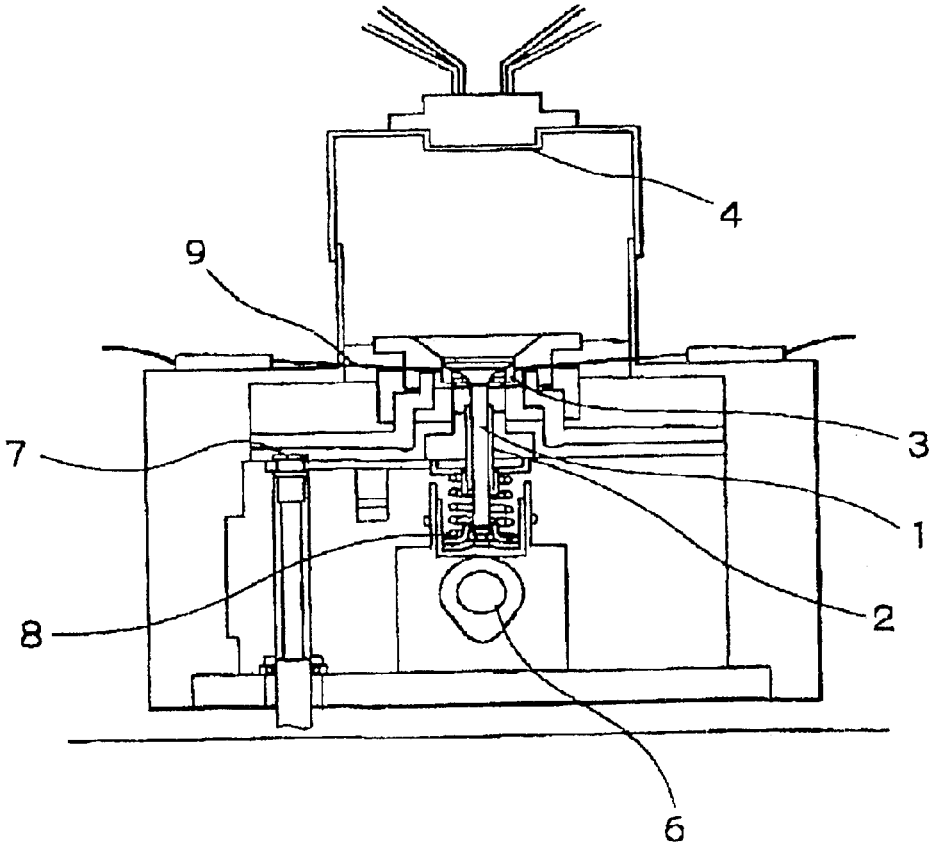
Fig. 1 PRIOR ART
FIG. 1 shows the hammering wear tester

An example of the iron-based sintered alloy according to the present invention without the hard particles and the solid lubricant is produced by using the pure-iron powder having average particle-size of 75~150 $\mu$m, iron (Fe)-chromium (Cr) alloy powder having average particle size of 75~200 $\mu$m, pure nickel (Ni) powder having particle size less than 45 $\mu$m, and fine graphite powder, The proportion of these powders was determined to obtain the compositions shown in Table 1. Zinc stearate of 0.5% was added as the lubricant to improve mold release property of the green compact. The resultant green mixture was pressed under the pressure of 637 MPa. Dewaxing was carried out at 650° C. for 1 hour. Sintering was carried out at 1180° C. for 2 hours followed by gas quenching. Annealing was then carried out at 650° C. The test pieces of Nos. 1 through 17 were thus prepared.

Examples of the iron-based sintered alloy according to the present invention with the hard particles and/or the solid lubricants were produced by using the pure-iron powder having average particle size of 75~150 μm, iron-chromium (Fe—Cr) alloy powder (Cr content=12%) having average particle size of 75~106 μm, pure nickel (Ni) powder having particle size less than 45 μm, fine graphite powder, and molybdenum-iron (Mo-Fe) alloy powder having average particle-size of 75~150 μm and/or calcium fluoride ($CaF_2$) particles as the solid lubricant.

In the basic powder mixture, 2.5 parts of pure nickel powder, 8.3 parts of iron-chromium (Fe-12% Cr) alloy powder, 1.1 parts of graphite powder, and 10 parts of molybdenum-iron (FeMo) powder were mixed. The pure nickel (Ni) powder, iron-chromium (Fe-12% Cr) alloy powder and the pure iron powder were added to the basic powder mixture so as to provide a pre-mix powder expressed by Fe-X% Cr-Y% Ni-Z% C composition by weight shown in Table 2. Hard particles and solid lubricant were added to the pre-mix powder. Zinc stearate of 0.5% was added as the lubricant to improve the mold release property of green compact. The resultant powder mixture was pressed under the pressure of 637 MPa. Dewaxing was carried out at 650° C. For 1 hour. Sintering was carried out at 1180° C. for 2 hours followed by gas quenching. Annealing was then carried out at 650° C. The test pieces of Nos. 18 through 29 were thus prepared.

Subsequently, heat treatment was carried out at specified temperatures depending upon the composition so as to adjust the hardness to HRB=80~110 of the Rockwell B scale.

Test pieces of Nos. 0 and 30 are the conventional sintered alloy used for a valve seat and were prepared as the comparative examples.

The test pieces were machined in the form of a valve seat and subjected to the friction and wear test under the following conditions which simulate the operating condition of a valve sheet.

Valve material: 21-4N tufftrided
Cam Revolution Speed: 3000 rpm
Testing Time: 5 hours
Temperature (outer face temperature of a valve seat): 150–350° C.

A valve seat is mounted in the hammering wear tester shown in FIG. 1. Respective configuration of the valve and the valve seat was measured before and after the test to evaluate the wear resistance. As shown in FIG. 1, a valve 1 is supported by the valve guide 2 and the upper end of the valve 1 is engaged with the valve seat insert 3. Flame from a gas burner 4 is ejected downward toward the valve 1. The outer side of the valve seat insert 3 is cooled by means of the water channel 7. The valve 1 is constantly pressed toward the cam shaft 6 and vertically moves by the rotation of a cam shaft 6. Tappet is denoted by 8.

In Tables 1 and 2 are shown the material properties of the inventive and comparative materials, and the evaluation result of the wear resistance tested by the hammering wear tester. In cost evaluation, the cost of the conventional materials (Comparative Nos. 0 and 30) is indicated as 100, and that of inventive materials is indicated by the relative value compared with 100. Cost reduction attained is approximately 40%.

TABLE 1

| No. | Matrix Composition | Hard Particles | Solid Lubricant | <Hardness> (HRB) | <Sintered Compact> (kg/m³) | <RAdial Crushing Strength> (MPa) | <Wear Amount (μm)> Value Seat | Value | Total Wear Amount | Relative Cost | |
|---|---|---|---|---|---|---|---|---|---|---|---|
| 0 | Fe-2.5Cr-1.8Ni-3.2Mo-0.4Co | — | — | 97.8 | 6.856 | 929 | 50 | 19 | 69 | 100 | Comparative |
| 1 | Fe-0.3Cr-0.3Ni-0.4C | — | — | 86.3 | 7.255 | 1125 | 75 | 28 | 103 | 45 | ↑ |
| 2 | Fe-0.5Cr-0.5Ni-0.95C | — | — | 88.0 | 7.242 | 1100 | 48 | 20 | 68 | 50 | Inventive |
| 3 | Fe-0.5Cr-1.0Ni-0.95C | — | — | 82.1 | 7.173 | 1026 | 55 | 12 | 67 | 53 | ↑ |
| 4 | Fe-0.5Cr-1.5Ni-0.95C | — | — | 84.5 | 7.174 | 1056 | 46 | 21 | 67 | 55 | ↑ |
| 5 | Fe-1.0Cr-0.5Ni-1.0C | — | — | 86.4 | 7.128 | 1080 | 53 | 23 | 76 | 57 | ↑ |
| 6 | Fe-1.0Cr-1.0Ni-1.0C | — | — | 85.0 | 7.130 | 1063 | 52 | 11 | 63 | 58 | ↑ |
| 7 | Fe-1.0Cr-1.5Ni-1.0C | — | — | 86.0 | 7.130 | 1075 | 45 | 15 | 60 | 60 | ↑ |
| 8 | Fe-1.5Cr-0.5Ni-1.05C | — | — | 84.5 | 7.072 | 1057 | 40 | 22 | 62 | 57 | ↑ |
| 9 | Fe-1.5Cr-1.0Ni-1.05C | — | — | 87.6 | 7.085 | 1095 | 46 | 20 | 66 | 58 | ↑ |
| 10 | Fe-1.5Cr-1.5Ni-1.05C | — | — | 89.5 | 7.096 | 1118 | 55 | 15 | 70 | 61 | ↑ |
| 11 | Fe-4Cr-1.5Ni-2.0C | — | — | 93.3 | 7.077 | 1188 | 25 | 40 | 65 | 65 | ↑ |
| 12 | Fe-4Cr-5Ni-1.0C | — | — | 96.0 | 7.088 | 1188 | 45 | 30 | 75 | 70 | ↑ |
| 13 | Fe-4.5Cr-1.5Ni-2.0C | — | — | 94.2 | 7.076 | 1188 | 35 | 50 | 85 | 66 | Comparative |
| 14 | Fe-4Cr-1.5Ni-2.2C | — | — | 94.3 | 7.090 | 1188 | 50 | 70 | 120 | 66 | ↑ |
| 15 | Fe-4Cr-6Ni-1.05C | — | — | 95.0 | 7.062 | 1188 | 45 | 55 | 100 | 72 | ↑ |
| 16 | Fe-4Cr-6.5Ni-1.05C | — | — | 94.0 | 7.055 | 1175 | 80 | 80 | 160 | 73 | ↑ |
| 17 | Fe-4.5Cr-6Ni-1.05C | — | — | 96.0 | 7.066 | 1200 | 85 | 90 | 175 | 72 | ↑ |
| 0' | Fe-2.5Cr-1.8Ni-3.2Mo-0.4Co | — | — | — | — | — | — | — | — | 150 | ↑ (Copper Infiltration) |

TABLE 2

| No. | Matrix Composition | Hard Particles | Solid Lubricant | <Hardness> (HRB) | <Sintered Compact> (kg/m³) | <Radial Crushing Strength> (MPa) | <Wear Amount (μm)> Value Seat | Value | Total Wear Amount | Relative Cost | |
|---|---|---|---|---|---|---|---|---|---|---|---|
| 18 | Fe-0.5Cr-0.5Ni-1.0C | FeMo | CaF2 | 94.3 | 6.952 | 849 | 45 | 20 | 65 | 55 | Inventive |
| 19 | Fe-0.5Cr-0.5Ni-1.0C | FeMo | — | 102.3 | 7.053 | 866 | 45 | 20 | 65 | 56 | ↑ |
| 20 | Fe-0.5Cr-0.5Ni-1.0C | — | CaF2 | 86.2 | 6.989 | 870 | 45 | 20 | 65 | 57 | ↑ |
| 21 | Fe-1.0Cr-2.0Ni-1.0C | FeMo | CaF2 | 95.2 | 6.936 | 857 | 52 | 21 | 73 | 56 | ↑ |
| 22 | Fe-1.5Cr-2.5Ni-1.05C | FeMo | CaF2 | 93.3 | 6.929 | 877 | 50 | 22 | 72 | 58 | ↑ |
| 23 | Fe-1.0Cr-4.0Ni-1.05C | FeMo | CaF2 | 92.0 | 6.927 | 845 | 49 | 24 | 73 | 60 | ↑ |
| 24 | Fe-4Cr-5Ni-1.0C | FeMo | CaF3 | 105.2 | 6.933 | 816 | 48 | 26 | 74 | 65 | ↑ |
| 25 | Fe-4Cr-5Ni-1.0C | FeMo | — | 107.2 | 6.998 | 835 | 47 | 28 | 75 | 64 | ↑ |
| 26 | Fe-4Cr-5Ni-1.0C | — | CaF2 | 101.3 | 6.989 | 842 | 46 | 30 | 76 | 64 | ↑ |
| 27 | Fe-4Cr-6Ni-1.05C | FeMo | CaF2 | 104.8 | 6.946 | 869 | 42 | 58 | 100 | 68 | Comparative |
| 28 | Fe-4Cr-6.5Ni-1.05C | FeMo | CaF2 | 105.4 | 6.930 | 857 | 37 | 90 | 127 | 69 | ↑ |
| 29 | Fe-4.5Cr-6.5Ni-1.05C | FeMo | CaF2 | 104.7 | 6.966 | 878 | 43 | 88 | 131 | 70 | ↑ |
| 30 | Fe-1.0Cr-4Ni-11Mo-0.8C | FeMo | CaF2 | 108.1 | 6.91 | 740 | 48 | 21 | 69 | 100 | ↑ |
| 30' | Fe-1.0Cr-4Ni-11Mo-0.8C | FeMo | CaF2 | — | — | — | — | — | — | 150 | ↑ (Copper Infiltration) |

The composition of No. 0 (Comparative Material) lies outside the inventive composition in the points that molybdenum (Mo) is contained and carbon (C) is impurity level. Since the carbon (C) content and hence the amount of liquid phase is small, the density of the sintered compact is low. As a result, the radial crushing strength is low. Hardness is high due to the intermetallic compound containing molybdenum (Mo). Added Cobalt (Co) enhances the heat resistance and hence improves the wear resistance.

The composition of No. 1 (Comparative Material) lies outside the inventive composition in the point that; the contents of nickel (Ni), chromium (Cr) and carbon (C) are lower than the inventive range. As a result, the wear resistance is poor.

The amounts of nickel (Ni) and carbon (C) of No. 13 (Comparative Material) lies within the inventive range, but the amount of chromium (Cr) is more than the inventive upper limit. Hardness, density and radial crushing strength of the sintered compact (hereinafter collectively referred to as "the mechanical properties") are, therefore, excellent. However, wear of the opposite material. i.e., the valve, is extremely serious.

The amounts of nickel (Ni) and chromium (Cr) of No. 14 (Comparative Material) lie within the inventive range, but the amount of carbon (C) is more than the inventive upper limit. The mechanical properties are, therefore, excellent. However, wear of the opposite material, i.e., the valve, is extremely serious The amounts of chromium (Cr) and carbon (C) of No. 15 (Comparative Material) lie within the inventive range, but the amount of nickel (Ni) is more than the inventive upper limit. The mechanical properties are, therefore, excellent. However, wear of the opposite material, i.e., the valve, is extremely serious.

The amount of nickel (Ni) of No. 16 (Comparative Material) is more than that of No. 15 by only 0.5%. Reduction of the mechanical properties is slight, but the wear resistance is drastically impaired.

The amount of carbon (C) of No. 17 (Comparative Material) lies within the inventive range, but the amounts of nickel (Ni) and chromium (Cr) are more than the inventive upper limit. The radial crushing strength is the highest in Table 1. However, the wear resistance is the worst in Table 1.

In Table 2, Nos. 18 through 21 have the same matrix composition as that of No. 5 and contains hard particles and/or a solid lubricant. The wear amount of Nos. 18 through 21 is lower than that of No. 5.

In No. 27, hard particles are added to the material of No. 15. In No. 28, a solid lubricant is added to the material of No. 16. The opposite material is roughened in the materials of Nos. 27 and 28, and the roughened surface of the opposite materials, in turn, causes wear of the valve seat.

In No. 0', copper is infiltrated into No. 0. The cost increases by 1.5 times. In No. 30', copper is infiltrated into No. 30. The cost increases by 1.5 times as well.

As is described hereinabove, the iron-based sintered alloy according to the present invention for use as a valve seat of an internal combustion engine can be produced by using the pure-iron powder, iron-chromium alloy powder, nickel powder and carbon powder. Wear resistance is maintained at a moderate level while the additive amount of alloying elements is decreased to attain low cost.

What is claimed is:

1. An iron-based sintered alloy, which consists, by weight %, of from 0.5 to 5% of nickel (Ni), from 0.5 to 4% of chromium (Cr), from 0.5 to 2% of carbon (C), the balance being iron (Fe) and unavoidable impurities, and which has a micro-structure comprising an iron-based matrix containing the nickel (Ni) and a part of the chromium (Cr) as solutes and carbides containing the other part of the chromium (Cr) and dispersed in the matrix.

2. An iron-based sintered alloy composite which comprises, by weight %, 80 to 97% of an Fe—Cr—Ni—C alloy and from 3 to 20% by weight of hard particles, wherein said Fe—Cr—Ni—C alloy consists, by weight %, of from 0.5 to 5% of nickel (Ni), from 0.5 to 4% of chromium Cr, from 0.5 to 2% of carbon C, the balance being iron (Fe) and unavoidable impurities, and which has a micro-structure comprising an iron-based matrix containing the nickel (Ni) and a part of the chromium (Cr) as solutes and carbides containing the other part of the chromium (Cr) and dispersed in the matrix, and wherein said hard particles are at least one of hard particles (a) to (d) having the following compositions in weight percentage:

(a) hard particles which consist of from 50 to 57% of chromium (Cr), from 18 to 22% of molybdenum (Mo), from 8 to 12% of cobalt (Co), from 0.1 to 1.4% of carbon (C), from 0.8 to 1.3% of silicon (Si) and the balance being iron (Fe);

(b) hard particles which consist of from 27 to 33% of chromium (Cr), from 22 to 28% of tungsten (W), from 8 to 12% of cobalt (Co), from 1.7 to 2.3% of carbon (C), from 1.0 to 2.0% of silicon (Si) and the balance being iron (Fe);

(c) hard particles which consist of from 60 to 70% of molybdenum (Mo), 0.01% less of carbon (C) and the balance being iron (Fe); and (d) hard particles which consist of Stellite alloy.

3. An iron-based sintered alloy composite according to claim 2, wherein said hard particles have a particle size in a range of from 75 to 106 $\mu$m.

4. An iron-based sintered alloy composite according to claim 1, further comprising from 1 to 20% by weight of solid lubricant based on the weight of the iron-based sintered alloy composite.

5. An iron-based sintered alloy composite according to claim 4, wherein said solid lubricant is at least one selected from the group consisting of fluoride, boride and sulfide.

6. An iron-based sintered alloy composite according to claim 5, wherein said fluoride is at least one selected from the group consisting of $LiF_2$, $CaF_2$ and $BaF_2$.

7. An iron-based sintered alloy composite according to claim 5, wherein said boride is BN.

8. An iron-based sintered alloy composite according to claim 5, wherein said sulfide is MnS.

9. A valve seat of an internal combustion engine comprising an iron-based sintered alloy, which consists, by weight %, of from 0.5 to 5%, of nickel (Ni), from 0.5 to 4% of chromium (Cr), from 0.5 to 2% of carbon (C), the balance being iron (Fe) and unavoidable impurities, and which has a micro-structure comprising an iron-based matrix containing the nickel (Ni) and a part of the chromium (Cr) as solutes and carbides containing the other part of the chromium (Cr) and dispersed in the matrix.

10. A valve seat of an internal combustion engine, which comprises an iron-based sintered alloy composite comprising, by weight %, 80 to 97% of an Fe—Cr—Ni—C alloy and from 3 to 20% by weight of hard particles, wherein said Fe—Cr—Ni—C alloy consists, by weight %, of from 0.5 to 5% of nickel (Ni), from 0.5 to 4% of chromium (Cr), from 0.5 to 2% of carbon (C), the balance being iron (Fe) and unavoidable impurities, and which has a micro-structure comprising an iron-based matrix containing the nickel (Ni) and a part of the chromium (Cr) as solutes and carbides containing the other part of the chromium (Cr) and dispersed in the matrix, and wherein said hard particles are at least one of hard particles (a) to (d) having the following compositions in weight percentage:

(a) hard particles which consist of from 50 to 57% of chromium (Cr), from 18 to 22% of molybdenum (Mo), from 8 to 12% of cobalt (Co), from 0.1 to 1.4% of carbon (C), from 0.8 to 1.3% of silicon (Si) and the balance being iron (Fe);

(b) hard particles which consist of from 27 to 33% of chromium (Cr), from 22 to 28% of tungsten (W), from 8 to 12% of cobalt (Co), from 1.7 to 2.3% of carbon (C), from 1.0 to 2.0% of silicon (Si) and the balance being iron (Fe);

(c) hard particles which consist of from 60 to 70% of molybdenum (Mo), 0.01% less of carbon and the balance being iron (Fe); and (d) hard particles which consist of Stellite alloy.

11. A valve seat according to claim 10, wherein said hard particles have a particle size in a range of from 75 to 106 $\mu$m.

12. A valve seat according to claim 9, wherein said iron-based sintered alloy further comprises from 1 to 20% by weight of solid lubricant based on the weight of the iron-based sintered alloy.

13. A method for producing an iron-based sintered alloy comprising the steps of:

preparing a raw material powder, which consists, by weight %, of from 0.5 to 5% of nickel (Ni), from 0.5 to 4% of chromium (Cr), from 0.5 to 2% of carbon (C), the balance being iron (Fe) by using at least an iron (Fe)-chromium (Cr) powder capable of supplying the total amount of chromium (Cr);

mixing zinc stearate and said raw material powder to prepare a green mixture;

pressing the green mixture to form a green compact;

heating the green compact to dewax it; and, sintering the green compact followed by cooling.

14. A method according to claim 13, wherein said raw material powder consists of a pure-iron powder, the iron powder which contains chromium ((Cr), a nickel powder and a graphite powder.

15. A method for producing an iron-based sintered alloy composite comprising the steps of:

preparing a raw material powder, which comprises a metal portion and hard particles, said metal portion consisting, by weight %, of from 0.5 to 5% of nickel (Ni), from 0.5 to 4% of chromium (Cr), from 0.5 to 2% of carbon (C), the balance being iron (Fe) and unavoidable impurities and comprising an iron (Fe)-chromium (Cr) powder capable of supplying the total amount of chromium (Cr), and said hard particles being from 3 to 30% by weight based on the raw material powder and consisting of at least one selected from the following groups:

(a) hard particles which consist of from 50 to 57% of chromium (Cr), from 18 to 22% of molybdenum (Mo), from 8 to 12% of cobalt (Co), from 0.1 to 1.4% of carbon (C), from 0.8 to 1.3% of silicon (Si) and the balance being iron (Fe);

(b) hard particles which consist of from 27 to 33% of chromium (Cr), from 22 to 28% of tungsten (W), from 8 to 12% of cobalt (Co), from 1.7 to 2.3% of carbon (C), from 1.0 to 2.0% of silicon (Si) and the balance being iron (Fe);

(c) hard particles which consist of from 60 to 70% of molybdenum (Mo), 0.01% less of carbon and the balance being iron (Fe); and (d) hard particles which consist of Stellite alloy, mixing zinc stearate and said raw material powder to prepare a green mixture;

pressing the green mixture to form a green compact;

heating the green compact to dewax it; and, sintering the green compact followed by cooling.

16. A method according to claim 15, wherein said raw material powder consists of a pure-iron powder, the iron powder which contains chromium (Cr), a nickel powder and a graphite powder.

17. A method for producing an iron-based sintered alloy comprising the steps of:

preparing a raw material powder, which consists of a metal portion and a solid lubricant, said metal portion consisting, by weight %, of from 0.5 to 5% of nickel (Ni), from 0.5 to 4% of chromium (Cr), from 0.5 to 2% of carbon (C), the balance being iron (Fe) and unavoidable impurities and comprising an iron (Fe)-chromium (Cr) powder capable of supplying the total amount of chromium (Cr), and said solid lubricant being from 1 to 20% by weight based on the raw material powder;

mixing zinc stearate and said raw material powder to prepare a green mixture;

pressing the green mixture to form a green compact;

heating the green compact to dewax it; and, sintering the green compact followed by cooling.

18. A method according to claim 17, wherein said raw material powder consists of a pure-iron powder, the iron powder which contains chromium (Cr), a nickel powder and a graphite powder.

19. A method for producing an iron-based sintered alloy composite comprising the steps of:

preparing a raw material powder, which comprises a metal portion, hard particles and a solid lubricant, said metal portion consisting, by weight %, of from 0.5 to 5% of nickel (Ni), from 0.5 to 4% of chromium (Cr), from 0.5 to 2% of carbon (C), the balance being iron (Fe) and unavoidable impurities and comprising an iron (Fe)-chromium (Cr) powder capable of supplying the total amount of chromium (Cr), said solid lubricant being from 1 to 20% by weight based on the raw material powder, and said hard particles being from 3 to 30% by weight based on the raw material powder and consisting of at least one selected from the following groups:

(a) hard particles which consist of from 50 to 57% of chromium (Cr), from 18 to 22% of molybdenum (Mo), from 8 to 12% of cobalt (Co), from 0.1 to 1.4% of carbon (C), from 0.8 to 1.3% of silicon (Si) and the balance being iron (Fe);

(b) hard particles which consist of from 27 to 33% of chromium (Cr), from 22 to 28% of tungsten (W), from 8 to 12% of cobalt (Co), from 1.7 to 2.3%, of carbon (C), from 1.0 to 2.0% of silicon (Si) and the balance being iron (Fe);

(c) hard particles which consist of from 60 to 70% of molybdenum (Mo), 0.01% less of carbon and the balance being iron (Fe);

(d) hard particles which consist of Stellite alloy, mixing zinc stearate and said raw material powder to prepare a green mixture;

pressing the green mixture to form a green compact;

heating the green compact to dewax it; and sintering the green compact followed by cooling.

20. A method according to claim 19, wherein said raw material powder consists of a pure-iron powder, the iron powder which contains chromium (Cr), a nickel powder and a graphite powder.

21. An iron-based sintered alloy composite according to claim 2, further comprising from 1 to 20% by weight of solid lubricant based on the weight of the iron-based sintered alloy composite.

22. A valve seat according to claim 10, wherein said iron-based sintered alloy composite further comprises from 1 to 20% by weight of solid lubricant based on the weight of the iron-based sintered alloy composite.

* * * * *